United States Patent [19]

Müller

[11] 4,090,441

[45] May 23, 1978

[54] APPARATUS FOR STACKING AND BALING NEWSPAPERS OR THE LIKE

[75] Inventor: Hans Müller, Zofingen, Switzerland

[73] Assignee: Grapha-Holding AG, Hergiswil, Switzerland

[21] Appl. No.: 761,500

[22] Filed: Jan. 21, 1977

[30] Foreign Application Priority Data

Jan. 27, 1976 Switzerland ..... 979/76

[51] Int. Cl.[2] ..... B65B 13/10; B65B 13/18

[52] U.S. Cl. ..... 100/7; 100/27; 93/93 DP; 198/626

[58] Field of Search ..... 100/2, 7, 27; 53/198 R; 271/4; 93/93 DP; 198/626

[56] References Cited

U.S. PATENT DOCUMENTS

| | | | |
|---|---|---|---|
| 2,679,789 | 6/1954 | Graves | 93/93 DP |
| 2,684,626 | 7/1954 | Eberle | 100/7 |
| 3,077,157 | 2/1963 | Gordon | 100/7 |
| 3,225,684 | 12/1965 | Smith | 100/7 |
| 3,348,473 | 10/1967 | Luy | 93/93 DP |

*Primary Examiner*—Billy J. Wilhite
*Attorney, Agent, or Firm*—Peter K. Kontler

[57] ABSTRACT

Apparatus for baling newspapers or the like has a folding unit which folds and compacts successive newspapers and delivers successive folded newspapers to a conveyor which advances the newspapers onto a support on which the newspapers pile up to form a stack. A pusher is operated intermittently to transfer successive stacks into the range of a transporting unit which advances each stack against a retractible gate whereby the stack is held in an optimum position for looping a cord therearound before the gate opens to permit the transporting device to advance the thus obtained bale toward a packing machine. The transporting unit has a bottom guide which is assembled of a front and a rear belt conveyor and a stationary bridge between the conveyors, and two lateral guide members which terminate short of the gate. When a stack abuts against the gate, its trailing portion is still located between the lateral guide members and a portion of the stack extends across a gap between the front belt conveyor and the bridge. The cord is looped around that portion of the arrested stack which extends across the gap. The lateral guide members may constitute endless belt conveyors which are driven at the speed of the rear belt conveyor. If the rear belt conveyor is replaced with a stationary plate along which the stacks slide toward the bridge, the pusher moves the stacks all the way from the support and into abutment with the gate.

10 Claims, 3 Drawing Figures

APPARATUS FOR STACKING AND BALING NEWSPAPERS OR THE LIKE

BACKGROUND OF THE INVENTION

The present invention relates to apparatus for baling sheets, especially folded newspapers, magazines, periodicals and the like. More particularly, the invention relates improvements in apparatus of the type wherein newspapers or the like (hereinafter called sheets for short) are folded, stacked and thereupon tied with a cord or the like to convert successive stacks into bales which are capable of standing mechanical treatment, e.g., during transport into and/or in a packing machine.

In accordance with a presently known technique, sheets (e.g., newspapers each of which has been folded three times) are piled up into relatively low stacks which are transferred by hand onto pallets serving for transport of stacked sheets into a baling machine. Such procedure is followed regardless of whether the sheets constitute relatively thick newspapers or relatively thin newspapers or brochures wherein the pages are held together by staples or the like. The reason for the palletizing of stacks is that a relatively tall stack of folded newspapers or the like cannot be transported by belt or chain conveyors since any, even minor, shaking of the conveyor can result in deformation and/or falling apart of the stack. The stacks on the aforementioned pallets are piled up on top of each other in the baling machine to form larger stacks which are thereupon tied by cords, bands or the like to form bales capable of standing transport by means of belt or chain conveyors and/or other treatment which, in the absence of baling, would result in collapsing or deformation of stacks.

OBJECTS AND SUMMARY OF THE INVENTION

An object of the invention is to provide an apparatus which can assemble folded newspapers or similar sheet material into tall stacks and can automatically transport such stacks into a baling machine.

Another object of the invention is to provide the apparatus with novel and improved means for manipulating stacks of newspapers or like sheet material between a stacking and a baling machine.

A further object of the invention is to provide the apparatus with novel and improved means for locating successive stacks in an optimum position and orientation in the baling machine.

An additional object of the invention is to provide an apparatus which is fully automated so that successive items of sheet material, such as newspapers, can be folded, stacked, baled and otherwise processed without any assistance from attendants.

An ancillary object of the invention is to provide novel and improved means for supporting, guiding and transporting stacks of newspapers or the like during travel toward, into and beyond a baling machine.

The invention is embodied in an apparatus for baling sheets, particularly folded newspapers. The apparatus comprises a support (e.g., a horizontal platform in a stacking machine or unit), means for conveying a succession of sheets from a folding unit onto the support, one above the other, so that the sheets pile up and form a growing stack, a pusher or an analogous transfer device which is operable to move fully grown stacks off the support in a predetermined direction, and transporting means extending in the aforementioned direction and defining an elongated path for fully grown stacks. The transporting means comprises a first guide device (which may consist of or include a front belt conveyor, a rear belt conveyor and a stationary bridge member between such conveyors) which is disposed below the path to support fully grown stacks from below, a second guide device having two lateral guide members flanking a portion of the path (each such guide member may constitute a stationary plate or an endless belt conveyor), and means (e.g., a cylinder and piston unit and/or an electric motor) for driving at least one of the aforementioned devices to thereby advance grown stacks along the path. The apparatus further comprises a retractible gate or stop which extends across the path forwardly of the lateral guide members to arrest an oncoming fully grown stack in a predetermined position in which the trailing end of such stack is disposed between the lateral guide members and a circumferentially complete portion of the arrested stack remains unobstructed (such circumferentially complete portion preferably extends across a gap between the aforementioned front conveyor and bridge member of the first guide device), and a baling unit or analogous means for looping a cord, band, strip or the like around the unobstructed portion of the arrested stack to thus convert the latter into a bale ready to be transported to a packing machine or the like as soon as the aforementioned gate opens to enable the front conveyor of the first guide device to advance the bale beyond the baling station.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
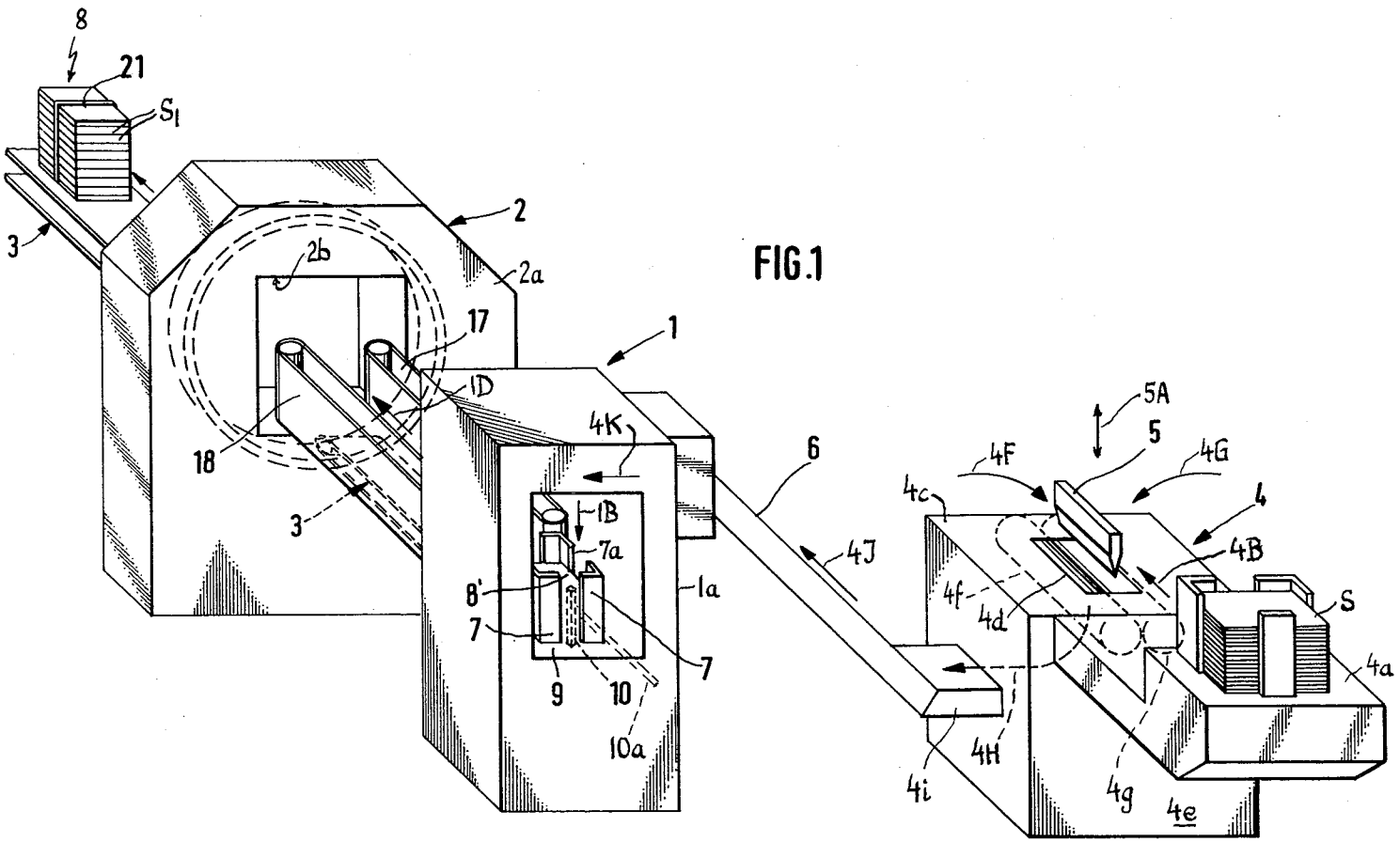
FIG. 1 is a perspective view of an apparatus which embodies the invention.

The apparatus of FIG. 1 comprises a sheet folding unit 4, a stacking unit 1 for folded sheets, a baling or binding unit 2, a conveying system 6 which advances successive folded sheets from the unit 4 to the unit 1, and a transporting unit 3 which advances stacks of folded sheets from the stacking unit 1 to the baling unit 2 and which also advances successive bales 8 beyond the unit 2.

The folding unit 4 comprises a platform 4*a* for a stack of unfolded, once-folded or twice-folded sheets S. A suitable feeding device (not specifically shown in FIG. 1 but known from the art of printing, copying and like machines) is installed in or below the platform 4*a* and advances (see the arrow 4B) successive lowermost sheets S into the range of a reciprocable folding sword 5 mounted above an opening 4*d* in a table 4*c* of the unit 4. The table 4*c* constitutes the top wall of a housing 4*e* which contains two driven compacting and advancing rolls 4*f*, 4*g* rotating in directions respectively indicated by arrows 4F, 4G. The directions in which the sword 5 is reciprocable are indicated by double-headed arrow 5A. The sword 5 moves downwardly, as viewed in FIG. 1, when a sheet S overlies the opening 4*d* in the table 4*c* whereby the sheet S is folded in the middle and its folded back enters the nip of the rolls 4*f*, 4*g* which compress and thereby flatten the folded back of the resulting folded sheet S1 and simultaneously advance the sheet S1 in the direction indicated by arrow 4H. Such sheet leaves the housing 4*e* by way of an outlet 4*i* and is engaged by the lower end of the conveying system 6 (which may include one or more belt or chain conveyors) to be transported in the direction indicated by arrows 4J and 4K into the upper portion of the housing 1*a* of the stacking unit 1. Successive sheets S1 which enter the housing 1*a* descend by moving sideways in the direction indicated by arrow 1B and form a stack 8′ which is confined between pairs of upright L-shaped corner members 7 and 7*a*. The corner members 7*a* (only one shown) are retractible. The lowermost sheet S1 of the stack 8′ rests on a platform or support 9 in the housing 1*a*. When the stack 8′ reaches a desired height, it is pushed forwardly (arrow 1D) by a reciprocable transfer member or pusher 10 (indicated by broken lines) which is moved from the retracted position of FIG. 1 simultaneously with or shortly after lateral movement (retraction) of the front corner members 7*a* in the housing 1*a*. A stacking unit which can be used in the apparatus of FIG. 1 is disclosed, for example, in Swiss Pat. No. 496,574. The transfer member 10 is movable forwardly through a clearance between the rear corner members 7 by a drive 10*a* (shown and described in detail in the aforementioned Swiss patent) whose stroke may but need not be adjustable.

Figure 2:
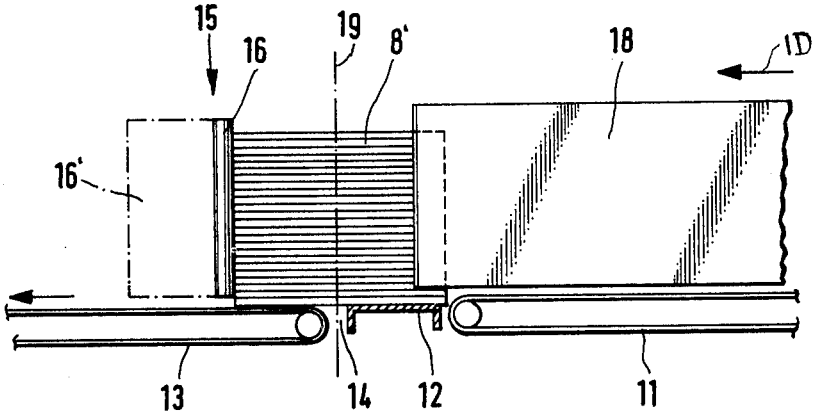
FIG. 2 is an enlarged fragmentary side elevational view of the transporting means.
Figure 3:
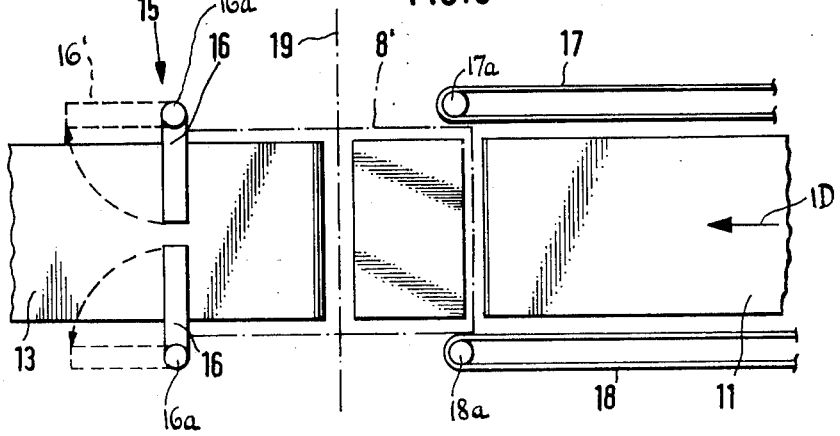
FIG. 3 is a plan view of the structure shown in FIG. 2.

The details of the transporting unit 3 which serves to advance successive stacks 8′ from the housing 1*a* into the housing 2*a* of the baling unit 2, and to thereupon advance successive bales 8 beyond the unit 2 are shown in FIGS. 2 and 3. The unit 3 comprises a first guide device 11–13 including a rear belt or chain conveyor 11 having a receiving end adjacent the support or platform 9 in the housing 1*a* and a discharge end adjacent a stationary bridge member 12. A front belt conveyor 13 has a receiving end adjacent to but spaced apart from the bridge member 12. The bridge member 12 and the receiving end of the conveyor 13 are located in an opening 2*b* of the housing 2*a*. The clearance or gap between the bridge member 12 and conveyor 13 is shown at 14. The housing 2*a* further supports a composite retractible stop or gate 15 having two upright panels 16 each of which is pivotable between an operative position (shown in FIG. 3 by solid lines) and an inoperative position 16′ (indicated by broken lines). The axes of pivot members 16*a* for the panels 16 are normal to the plane of the upper reach of the front conveyor 13 of the first guide device, and such pivot members are located at the opposite sides of the upper reach of 13. When the panels 16 assume their inoperative positions 16′, they permit the conveyor 13 to transport a freshly formed bale 8 from the opening 2*b* of the housing 2*a* beyond the baling unit 2 to a station where the bale can be picked up and/or otherwise manipulated by mechanical lifting and transferring means, not shown.

The transporting unit 3 further comprises a second guide device including two lateral guide members 17, 18 each of which is an endless belt or chain conveyor having a vertical inner reach located in a plane normal to the plane of the upper reach of the rear conveyor 11. The guide members 17, 18 flank the rear conveyor 11 between the housings 1*a* and 2*a* to form therewith a portion of an elongated path along which successive fully grown stacks 8′ advance to the baling station, either in response to forward movement of the pusher 10 or due to movement of the upper reach of the rear conveyor 11 and the inner reaches of the guide members 17, 18. The arrangement is preferably such that the speed of the rear conveyor 11 equals that of the guide members 17, 18. FIGS. 2 and 3 show that the forward end turns of the guide members 17, 18 extend beyond the discharge end of the rear conveyor 11, i.e., the rollers 17*a*, 18*a* over which the endless flexible elements of the guide members 17, 18 are trained flank the left-hand end portion of the bridge member 12. The distance between the gate 15 (in operative positions of the panels 16) and the rear conveyor 11 exceeds the length of a fully grown stack 8′ (as considered in the direction indicated by arrow 1D). On the other hand, the distance between the gate 15 (in operative positions of the panels 16) and the guide members 17, 18 is at least slightly less than the length of a stack 8′ so that the rear or trailing portion of a stack whose front side abuts the panels 16 is still located in the foremost part of the channel between the guide members 17, 18 and bridge member 12.

The reference character 19 denotes the plane in which the baling unit 2 ties a cord or the like around a circumferentially complete unobstructed portion of a stack 8′ which abuts against the panels 16 to thus convert the stack into a bale 8. The cord of a bale 8 on the conveyor 13 is shown at 21. The unobstructed portion of the stack 8′ shown in FIGS. 2 and 3 extends across the gap 14 between the bridge member 12 and front conveyor 13 of the first guide device.

The operation is as follows:

The sheet folding unit 4 delivers a series of folded sheets S1 to the conveying system 6 which transports such sheets into the housing 1*a* of the stacking unit 1. The sheets S1 are assembled into a stack 8′ which is confined between the corner members 7 and 7*a*. When the height of the stack 8′ reaches a preselected value, i.e., when the stack is fully grown, the drive 10*a* causes the pusher 10 to perform a forward stroke and to transfer the stack 8′ (upon retraction of corner members 7*a*) onto the upper reach of the rear conveyor 11 which advances the stack 8′ between the guide members 17, 18 and onto the bridge member 12. The front side of the stack 8′ abuts against and the stack is arrested by the panels 16 which are held in the operative positions. The distance between the inner reaches of the guide members 17, 18 equals or is slightly less than the width of a stack 8′ (as considered at right angles to the direction indicated by arrow 1D), i.e., the guide members 17, 18 assist the upper reach of the rear conveyor 11 in advancing the fully grown stack toward and onto the bridge member 12. The front portion of the lowermost sheet S1 of the stack 8′ is transferred onto and is advanced by the upper reach of the front conveyor 13 before the rear portion of such lowermost sheet moves beyond the upper reach of the rear conveyor 11. This insures that the stack 8′ invariably reaches the closed gate 15.

The front conveyor 13 remains in motion after the front side of the stack 8′ reaches and is arrested by the closed gate 15; the upper reach of the front conveyor 13 then simply slides relative to the lowermost sheet S1 of the arrested stack. As mentioned above, the rear portion of the stack 8' which abuts against the closed gate 15 remains in the space between the front ends of the guide members 17, 18. Such arrangement insures that the sheets S1 of the stack remain in accurate register with each other because the front side of the stack abuts against the panels 16, the bottom sheet of the stack rests on the upper reach of the conveyor 13 as well as on the bridge member 12, and the rear portions of lateral sides of the stack are engaged by the inner reaches of the guide members 17, 18.

The baling unit 2 is then actuated to loop a cord around the stack 8' which abuts against the closed gate 15. The cord preferably forms a single loop which is disposed in the plane 19. It will be noted that this plane extends across the gap 14, i.e., that the bridge member 12 and/or the conveyor 13 cannot interfere with the looping of cord around the unobstructed portion of the stack 8'. In the next step, the mechanism in the housing **2*a* pivots the panels 16 to the inoperative positions 16' whereby the upper reach of the front conveyor 13 automatically advances the freshly formed bale 8 beyond the opening 2*b* in the housing 2*a*. The cord 21 keeps the sheets S1 of the bale 8 against movement relative to each other and lends to the bale necessary stability which is required for further processing. The front conveyor 13 delivers the bale 8** to a centrally located packing machine (not shown), either directly or through the medium of one or more switching devices and/or additional conveyors.

The improved apparatus exhibits many important advantages. Thus, the stacking unit 1 can assemble stacks of any desired practical height which greatly exceeds the height of stacks that can be assembled in conventional apparatus prior to transfer onto pallets, i.e., prior to introduction into the baling unit. Furthermore, the manipulation of sheets, starting with folding in the unit 4 and terminating with delivery of bales to a packing machine or to another destination is automated so that a single attendant can supervise the operation of the entire apparatus. Still further, the conversion of sheets into bales is much faster than in conventional apparatus wherein the stacks are loaded onto pallets for transport to the baling unit. Moreover, the stacks cannot or are highly unlikely to be deformed or to collapse during assembly and/or during transport into, during treatment in and during transport beyond the baling unit.

Baling units capable of being used in the apparatus of FIG. 1 are available from STRAPEX AG, CH-5610 Wohlen, Switzerland.

Without further analysis, the foregoing will so fully reveal the gist of the present invention that others can, by applying current knowledge, readily adapt it for various applications without omitting features which, from the standpoint of prior art, fairly constitute essential characteristics of the generic and specific aspects of my contribution to the art and, therefore, such adaptations should and are intended to be comprehended within the meaning and range of equivalence of the appended claims.

What is claimed is:

1. Apparatus for baling sheets, particularly folded newspapers or the like, comprising a support; means for conveying a succession of sheets onto said support, one above the other, so that the sheets pile up and form a growing stack; a transfer device operable to move fully grown stacks off said support in a predetermined direction; transporting means extending in said direction and defining an elongated path for grown stacks, said transporting means comprising a first guide device disposed below said path and contacting a first side of a grown stack thereon, a second guide device having two lateral guide members flanking said path and contacting two additional sides of a grown stack thereon, and means for driving said devices at the same speed to thereby advance grown stacks along said path by transmitting motion to said one side and to said additional sides of a grown stack in said path; a retractible stop extending across said path to arrest an oncoming grown stack in a predetermined position in which the trailing end of such stack is disposed between said lateral guide members and a circumferentially complete portion of the arrested stack remains unobstructed; and means for looping a cord or the like around the unobstructed portion of the arrested stack to thus convert the latter into a bale.

2. Apparatus as defined in claim 1, wherein said lateral guide members include stack-engaging portions disposed at right angles to said first guide device.

3. Apparatus as defined in claim 1, wherein said first guide device comprises a conveyor located forwardly of said lateral guide members and a stationary bridge member disposed behind said conveyor, as considered in said direction, and defining therewith a gap in alignment with the unobstructed portion of that fully grown stack which is held in said predetermined position.

4. Apparatus as defined in claim 3, wherein said first guide device further comprises a second conveyor located behind said bridge member, as considered in said direction, and flanked by said lateral guide members.

5. Apparatus as defined in claim 1, wherein each of said lateral guide members is a conveyor.

6. Apparatus as defined in claim 5, wherein said first guide device comprises a further conveyor disposed between said lateral guide members and arranged to advance a fully grown stack toward said stop.

7. Apparatus as defined in claim 1, wherein said stop comprises at least one panel pivotable between an operative and an inoperative position in which said panel respectively extends across and is retracted from said path.

8. Apparatus as defined in claim 1, wherein said transfer device comprises a reciprocable pusher.

9. Apparatus as defined in claim 1, wherein said first guide device comprises a continuously driven conveyor on which a stack rests while abutting against said stop and which advances the bale beyond said lateral guide members upon retraction of said stop.

10. Apparatus as defined in claim 1, wherein said path is substantially horizontal and each of said guide devices comprises at least one endless belt or chain conveyor.

* * * * *